US005623292A

United States Patent [19]

Shrivastava et al.

[11] Patent Number: 5,623,292

[45] Date of Patent: Apr. 22, 1997

[54] TEMPERATURE CONTROLLER FOR INK JET PRINTING

[75] Inventors: Dilip K. Shrivastava, Wheeling; Richard Sutera, Schaumburg, both of Ill.

[73] Assignee: Videojet Systems International, Inc., Wood Dale, Ill.

[21] Appl. No.: 169,669

[22] Filed: Dec. 17, 1993

[51] Int. Cl.[6] ..... B41J 29/377

[52] U.S. Cl. ..... 347/18; 62/3.3; 236/91 F

[58] Field of Search ..... 62/3.3; 236/91 F; 237/3 B; 347/17, 18

[56] References Cited

U.S. PATENT DOCUMENTS

| | | | |
|---|---|---|---|
| 4,555,712 | 11/1985 | Arway et al. . | |
| 4,636,809 | 1/1987 | Eremity . | |
| 4,797,837 | 1/1989 | Brooks | 347/223 |
| 4,827,280 | 5/1989 | Stamer et al. . | |
| 4,860,027 | 8/1989 | Ozelis et al. . | |
| 5,006,867 | 4/1991 | Koizumi et al. | 347/17 |
| 5,451,989 | 9/1995 | Kadowaki et al. | 347/18 |

FOREIGN PATENT DOCUMENTS

| | | | |
|---|---|---|---|
| 60-115450 | 6/1985 | Japan | 347/18 |
| 3-86553 | 4/1991 | Japan | 347/18 |
| WO8912215 | 12/1989 | WIPO . | |
| 93/17870 | 9/1993 | WIPO | 347/17 |

OTHER PUBLICATIONS

Viscosity Control Circuit, IBM Technical Disclosure Bulletin, vol. 16, No. 10, Mar. 1974.

Abstract of Japanese Patent No. 01–301,257, published Dec. 5, 1989.

Abstract of Japanese Patent No. 60–115,450, published Jun. 21, 1985.

Abstract of Japanese Patent No. 57–146,662, published Sep. 10, 1982.

Technical manual for Cheshire Superior Resolution SR 25/50 printer.

"Thermoelectric Heat Pumps", Melcor Electronic Products Corporation (undated).

*Primary Examiner*—John E. Barlow, Jr.

*Attorney, Agent, or Firm*—Rudnick & Wolfe

[57] ABSTRACT

A temperature control unit is incorporated directly into the printhead of an ink jet printing system to provide temperature control. The temperature control system includes a heat pump assembly consisting of at least one thermoelectric device, coupled to a heat exchanger through which the ink flows. The thermoelectric device conveys heat to or from the heat exchanger carrying the ink depending upon actual ink temperature versus a desired temperature. If the ink is too hot, excess heat is dumped to a heat exchanger (or second heat exchanger) which may be air or liquid cooled. In the event that the ink is too cool, the electrical current to the TED is reversed and heat is pumped to the ink from the heat exchangers.

5 Claims, 4 Drawing Sheets

TEMPERATURE CONTROLLER FOR INK JET PRINTING

BACKGROUND OF THE INVENTION

This invention relates to ink jet systems in which a stream of electrically conductive ink is supplied to a nozzle. The ink is emitted from the nozzle as a stream, but breaks into discrete droplets due to the application of energy to the nozzle using, for example, a piezo-electric device. Near the point where the stream breaks into droplets, an electrode is provided which can selectively charge droplets. This causes them to be deflected onto a substrate to be marked by virtue of deflection electrodes located downstream of the charging electrode.

Such systems are well known in this art and may include drop-on-demand and continuous jet systems. In most cases, such systems use specially formulated inks for quick drying, clear marking and other characteristics which are desired by the user. These devices are temperature sensitive and therefore variation in ambient temperatures, such as in factories where products to be marked are being manufactured, adversely affect printing. For this reason, ink jet printing systems frequently locate the electronics and ink supplies inside a protective cabinet which is located remotely from the point where products are to be marked by the ink drops. The ink jet printhead including the nozzle is located at the point of marking and is connected to the cabinet by a relatively long (ten to thirty feet) umbilical-like tube which supplies both ink and electrical control signals to the printhead assembly.

Under these circumstances, it is somewhat difficult to maintain the ink at the optimum temperatures desired for best printing. For example, many ink jet systems are rated for use in environments within the temperature range of 40° to 110° Fahrenheit. Many inks, however, optimally operate within a temperature range of as little as plus or minus five degrees. For example, an ink formulated for use at 75° F. is desirably maintained between 70° and 80° F. during printing operations.

For this reason, means for controlling the temperature of ink used in ink jet systems are known. Prior efforts to control ink temperature have, however, centered on temperature control within the cabinet housing the principal ink jet components, at a location remote from the actual printing operation. Such prior art systems have principally focused on cooling inks before sending them through the umbilical to the printhead although it is also known to heat the ink at the cabinet. This is a less than effective method because of the length of the umbilical cord and the relatively small volume and low flow rate of ink which is transmitted therethrough. As a result of these factors, temperature control at the cabinet is generally unsatisfactory. Ink is at ambient temperature by the time it reaches the printhead at the end of the umbilical. Accurate temperature control, therefore, cannot be accomplished from the cabinet of such a printing system.

Failure to accurately control ink temperature at the printhead causes a change in flow time (or a change in flight time) of the ink. Most printing systems incorporate detecting mechanisms for measuring flow time and use this value to adjust the composition of the ink, as for example by adding solvent, in an effort to compensate for solvent evaporation. Existing detection systems cannot differentiate between a change in flow time due to solvent loss and changes due to temperature variation. Therefore, such monitoring systems adjust the viscosity of the ink by adding solvent whether the ink requires such addition or not. This can result in an ink composition which is very different from the composition intended, resulting in printing problems and loss of quality.

It is also known in the art to preheat ink at the printhead. Such intentional preheating is used, for example, to reduce the ink viscosity or decrease drying time. Such a concept does not provide positive temperature control at the printhead to maintain the ink within a desired temperature range, for example, plus or minus five degrees of its optimum value.

Accordingly, it is desired to provide a temperature control system which can maintain ink temperature within a predetermined, acceptable range of temperatures in the immediate environment of the printhead.

It is further desired to provide such a temperature control system which has a feedback circuit to monitor ink temperature and the capability to heat or cool the ink as required to maintain the desired temperature range.

It is a further object of the invention to provide such a temperature control system which is located directly in the printhead so that there will be a negligible change in the ink temperature from the time it is adjusted by the temperature control unit and the time it is supplied to the nozzle for printing purposes.

Another object is to provide a miniaturized heat pump for incorporation directly into the printhead to maintain temperature control.

SUMMARY OF THE INVENTION

These objects are accomplished by the present invention which comprises a heat pump type temperature control unit, the principal components of which are located within the ink jet printhead. The temperature control unit consists of a heat exchanger through which the ink passes on its way to the nozzle from the umbilical cord. In operative contact with the heat exchanger, which may comprise a labyrinth ink tube formed of a heat conductive metallic material, is one or preferably two, thermoelectric devices, commonly known as Peltier devices. Such devices employ an electric current passing through a junction consisting of two dissimilar metals (semi-conductors). This results in a cooling effect when the current passes in the first direction and a heating effect when the current is passed in the reverse direction. The thermoelectric devices (TEDS) have one surface in contact with the heat exchanger and the opposite surface in contact with a heat exchanger which may consist of either a circulating liquid jacket or a heat exchanger having air cooling fins. The application of electric current to the TED is controlled as a function of ink temperature, thereby to heat or cool the ink as necessary to maintain a desired temperature range. The feedback control may be accomplished using conventional PID, pulse width modulation, or "fuzzy logic" feedback signals.

DETAILED DESCRIPTION

Figure 1:
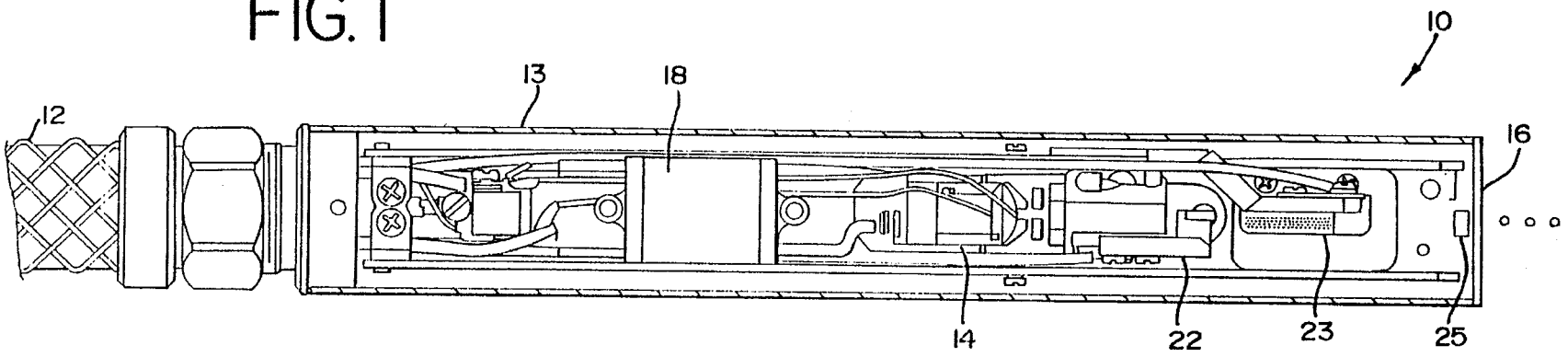
FIG. 1 is a cross-sectional view of a typical printhead suitable for use with the invention showing a temperature control assembly according to the invention, incorporated therein.

Referring to FIG. 1, there is illustrated a continuous jet printhead 10 suitable for use with the present invention. However, the invention can be used with a drop-on-demand jet printhead with equal success. The printhead is connected to a ink jet printing system by an umbilical cord 12. The printing system consists of an ink supply system, an ink monitoring system, a controller, usually microprocessor based, and associated elements which are conventional and are not, therefore, illustrated. In that connection, for additional background see U.S. Pat. Nos. 4,555,712 and 4,827,280 incorporated by reference. The printing system is located remotely from the printhead 10, hence the need for umbilical 12 which may be of a length of anywhere from 10 to 30 feet. This permits the easy and versatile placement of the printhead near the point of printing in environments where temperatures vary, for example, industrial and graphic printing operations.

The printhead assembly 10 consists of an outer housing or shell 13 which encases the internal components. These components include a nozzle 14 which is supplied with pressurized ink that is projected from an aperture or orifice (not shown) in the end 16 of the printhead housing as a stream of ink drops. In the usual installation, the ink is supplied from the umbilical 12 directly to the nozzle. Application of vibrational stimulation to the ink causes it to break up into droplets soon after it leaves the orifice. The printhead assembly 10 may also include an array of orifices instead of one orifice as exemplarily shown.

According to the present invention, in order to provide the desired temperature control the ink is supplied from umbilical 12 first to a temperature control assembly or module 18 and then to the nozzle 14 via suitable flexible conduits.

Located within the printhead housing is a temperature sensor 20. The sensor may be located on or adjacent the heat exchanger output or the ink outlet, as desired. This sensor is electrically connected via conductors which are contained in the umbilical 12 to the control electronics so that the system can determine the temperature of the ink at or near the nozzle 14. Based on this information, the temperature control unit is operated, as will be described hereafter, to heat or cool the ink immediately prior to delivery to the nozzle and its orifice. In this manner, inks which have a preferred operating range, typically plus or minus five degrees of their design temperature, can be maintained in the preferred operating range.

This capability of the present invention is not present in the prior art. In the prior art, cooling was accomplished at the main control unit prior to supplying the ink to the printhead. In typical industrial environments, the ambient temperature would significantly alter the ink temperature by the time it reached the printhead. Such alteration, where it causes the ink to be at a temperature other than within the preferred range, changes the viscosity and other characteristics of the ink, which characteristics are critical to accurate, high quality drop marking. Misplacement of drops or clogging of the nozzle due to out of specification ink, can severely impact printing quality.

More specifically, after the droplets leave the nozzle 14, only those drops which have been charged by a charge electrode 22 and deflected by deflection electrodes 23 leave the printhead through the end 16. Uncharged drops are captured by a catcher 25 or ink return opening which returns the ink, through the umbilical, back to the main ink reservoir in the cabinet. This return ink may be mixed with solvent or additional fresh ink controlled by a suitable monitoring system in an effort to maintain its composition relatively stable to ensure good printing.

Many such monitoring systems assume that variations in viscosity are due to the evaporative losses of the volatile solvents contained in the inks. Temperature, however, also affects viscosity and such variations can affect the viscosity measurements by a significant factor. As a consequence, the ink control system may respond detrimentally, rather than beneficially and fail to maintain the ink composition as desired in conformity with specifications. Thus, for example, too much or too little solvent might be added resulting in printer malfunctions or poor print quality.

Thus, temperature compensation is an important factor in the overall operating quality of an ink jet system. Efforts to cool the ink at the main unit have not been particularly successful for the reasons indicated because of the distance between the main unit and the printhead orifice. Further, such efforts do not permit accurate feedback control of the ink temperature to maintain it within a desired operating temperature range. With the present invention, the operating temperature of the ink can be maintained within a desired range regardless of the ambient temperature in which the printhead is placed (within the limits of the ability of the temperature control unit to heat or cool the ink). In this manner, the temperature of the ink can be controlled for optimal performance.

Figure 2A:
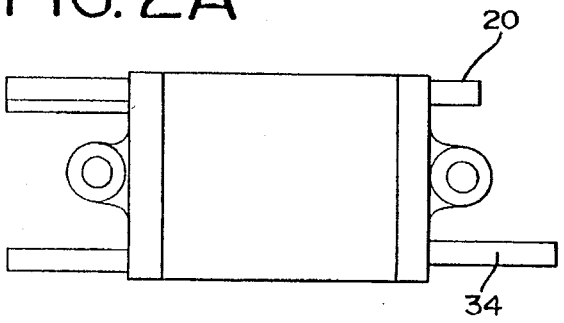
FIGS. 2 and 2*a* show end and top plan views, respectively, of the temperature control assembly according to the invention.
Figure 2:
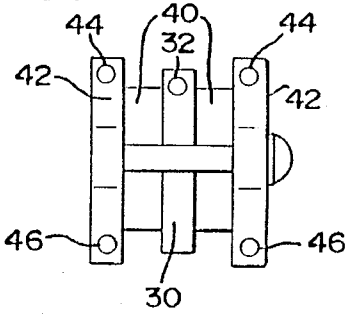
Figure 6:
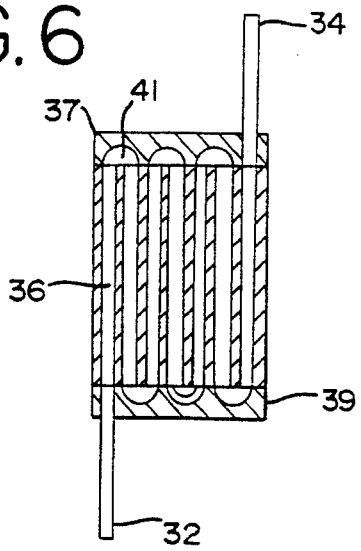
FIGS. 6 and 6*a* are plan views of a preferred heat exchanger arrangement for use with the temperature control assembly of the invention.
Figure 6A:
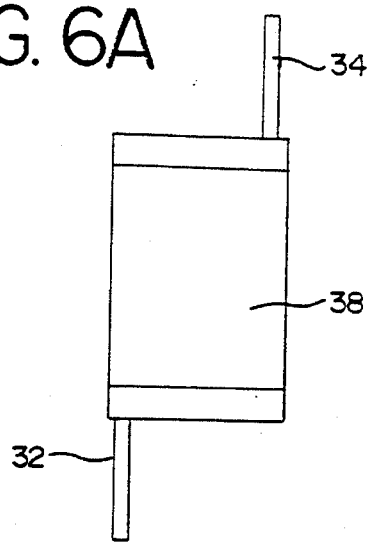

Referring to FIGS. 2 and 2*a*, end and side elevations of the temperature control assembly 18 are illustrated. As can be seen from the figures, the temperature control unit 18 includes a centrally disposed heat exchanger 30 having an ink input port 32 and an ink output port 34. As shown in FIGS. 6 and 6*a*, between the input and output ports, the ink passes through a labyrinth-like passage consisting of a series of s-shaped turns intended to maximize heat transfer with the ink. Preferably, the exchanger is formed by drilling the passages in a block of stainless steel. The passages are connected by welding to the block end caps 37 and 39, having cutouts 41. In this way, if the ink is hotter than the surfaces 38, heat will transfer from the ink to the surfaces. Conversely, if the ink is cooler than the surfaces 38, heat will be transferred from the surfaces to the ink contained within the passages 36. In this manner, the ink can be cooled or heated as necessary to maintain a desired temperature range.

Solely, for purposes of illustrating the invention, it will be assumed hereafter that the desired operating temperature for a particular ink is 75° Fahrenheit plus or minus five degrees. Thus, it is desired that the operating system to be described hereafter, maintain the ink at the nozzle at a temperature of between 70° and 80° Fahrenheit.

Figure 4:
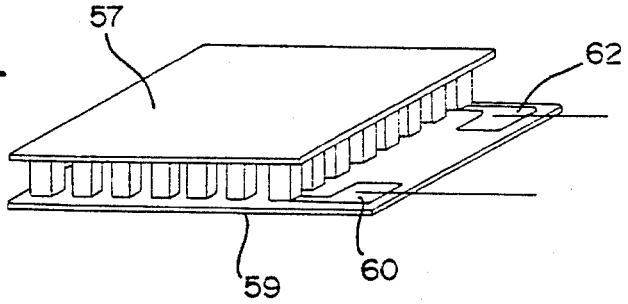
FIG. 4 is a perspective view of a TED of a type suitable for use in the present invention.
Figure 5:
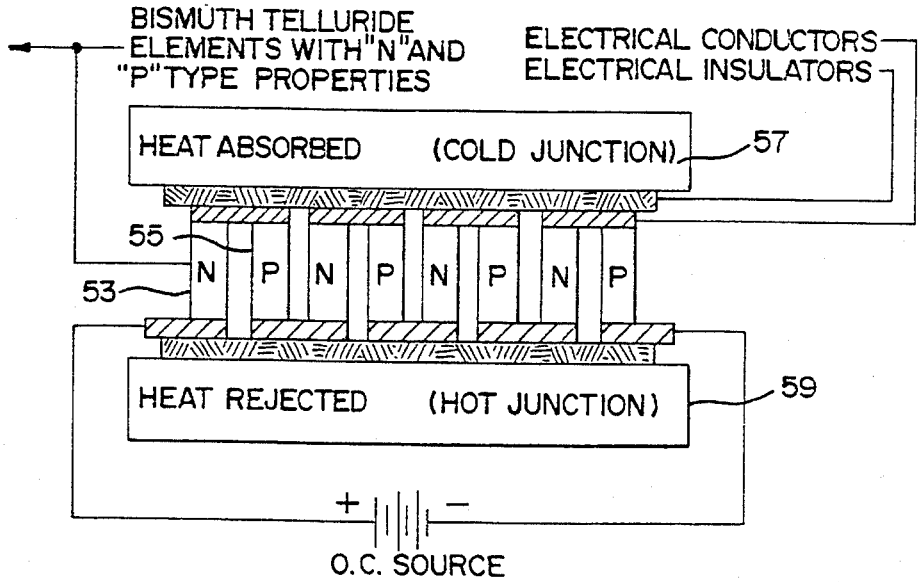
FIG. 5 is a simplified schematic explaining the operation of the TED.

Returning to FIGS. 2 and 2*a*, in physical contact with the heat exchanger unit 30 are one or preferably two thermoelectric devices (TEDS) 40. As indicated earlier, these are preferably Peltier devices which take advantage of the Peltier effect. These semi-conductor devices, described more fully in connection with FIG. 5, employ a phenomenon whereby the passage of electric current through a junction of two dissimilar metals (or dissimilarly doped metals) results in a cooling effect when the current flows in a first direction. When the current is reversed, heating will occur. In other words, the device functions as a heat pump to either heat or cool the surfaces with which it comes in contact as a function of the direction of current applied to the device. Manufacturers of such devices include: Materials Electronics Products Corporation (Melcor) of Trenton, New Jersey and a typical device which is suitable for use in the present invention are Models Cp 1.0-63-06L and Cp 1.0-63-08L or equivalents. FIG. 4 illustrates a typical TED module showing the two faces 57 and 59 through which heat is pumped depending upon the direction of the current applied. The electrical current is applied to conductive pads 60 and 62 respectively. Referring to FIG. 5, a typical TED module is illustrated in greater detail. Thermoelectric cooling couples are made from two elements of semiconductor material, for example, Bismuth Telluride, heavily doped to provide excess electrons (N Type) element 53 or conversely a deficiency (P Type) element 55. Heat is absorbed at a cold junction 57 and carried to a hot junction 59 at a rate proportional to the carrier current passing through the circuit and the number of couples. The couples are incorporated into a module as shown. They are electrically connected in series, but function thermally in parallel.

FIG. 5 shows a positive DC voltage applied to the left side of the module resulting in the junction 57 transferring heat to junction 59. Reversing the direction of current flow reverses the functions of the junctions. The TEDS 40 are electrically connected to the main printing control unit through electrical conductors which pass through the umbilical 12. In this manner they may be controlled to pump heat to or conduct cold from the heat exchanger thereby to control the ink temperature.

Contacting the outer faces of the TEDS 40 is a heat exchanger 42 (FIG. 2). The heat exchanger 42 may, in a preferred embodiment include a circulating liquid jacket (typically a heat exchange liquid). Alternatively, it may be air cooled as will be described in connection with a second embodiment. As illustrated in FIGS. 2 and 2*a* the preferred arrangement consists of a pair of heat exchangers, one disposed in contact with each of the two thermoelectric devices. It is possible, where the design requirements are less severe to employ only a single heat exchanger and TED. In either case, liquid enters the heat exchanger 42 through input ports 44 and exits through ports 46. The liquid reservoir for the heat exchanger is maintained at the main control unit and supplied by a recirculating pump via small diameter tubing through the umbilical 12 directly to the printhead.

Figure 3:
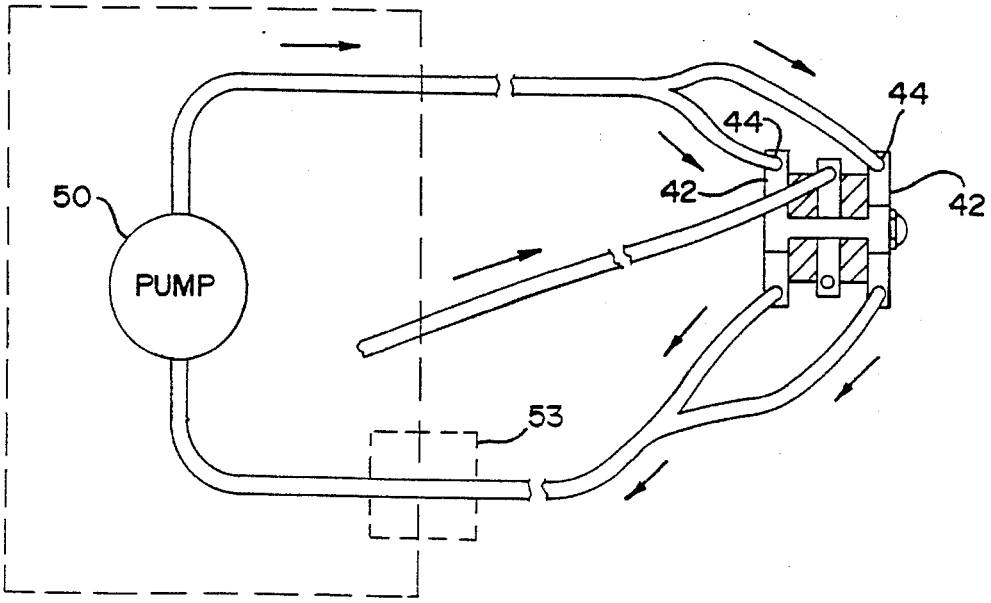
FIG. 3 is a diagram illustrating the manner in which a circulating liquid system is connected to the temperature control assembly through the umbilical attached to the printhead.

Depicted in FIG. 3 is a simplified schematic of the plumbing. The operation of the heat exchanger can be readily understood from it. A pump 50 in the print cabinet supplies liquid of a first temperature through the umbilical to the heat exchanger 42. The liquid either absorbs heat if the ink is too hot, or provides heat if the ink is too cool as determined by the ambient temperature in which the TEDS are operating. Thus, for example, if the ink is too hot the TEDS are biased to conduct heat from the ink and "pump" it to the liquid so that the incoming liquid will absorb the heat and carry it off. Excess heat picked up by the liquid can be transferred at some appropriate point remote from the printhead through conventional means, such as a fan blowing on an additional heat exchanger 53 in the form of a radiator or a set of fins. In some cases, the remote location may be air conditioned and simple air circulation may be sufficient to remove the excess heat.

Figure 7:
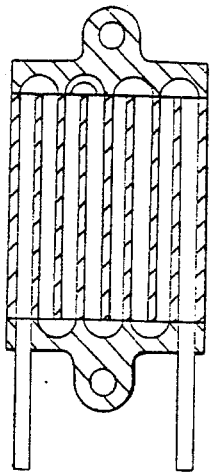
FIG. 7 is a view similar to FIG. 6 of another form of a heat exchanger adapted for the liquid circulation system.
Figure 7A:
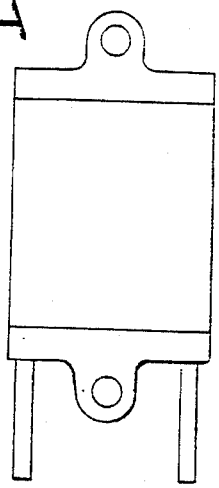

In the case where the ink is too cool or deficient in heat, the TEDS will be reverse biased to pump heat from the liquid to the ink to heat it resulting in the liquid returning from the printhead cooler then it entered. In either case, the result is that the ink temperature is raised or lowered as required to maintain it within the desired range of 70° to 80° in the postulated example. FIG. 7 illustrates a heat exchanger element in which the heat exchange liquid input and output ports are on the same side of the device. This is particularly suitable for use with the liquid heat exchanger system (elements 42 in FIG. 2).

As mentioned previously, the ink is supplied to and returned from the printhead via tubing or conduits which run in the umbilical. Where desired, a thermal relation can be provided between the ink in the return tubing and ink in the supply tubing. This permits "precooling" of hot ink before the ink reaches the TEDS thus reducing the load on the TEDS. Similarly, in a cold environment the return ink line can preheat the ink being supplied to the printhead. This use of return ink to prepare the incoming ink finds particular application to the air cooled embodiment of FIG. 8 which has somewhat less thermal transfer capacity than the embodiment using heat exchange liquid.

Figure 8:
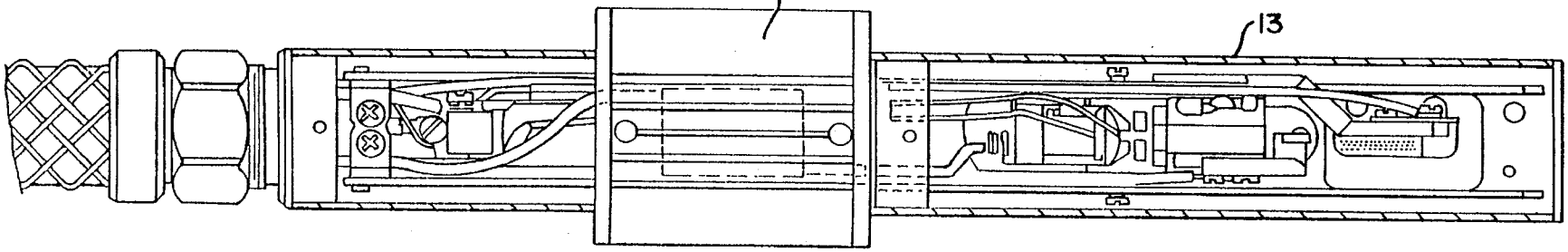
FIGS. 8, 8*a* and 8*b* illustrate an air cooled heat exchanger.
Figure 8B:
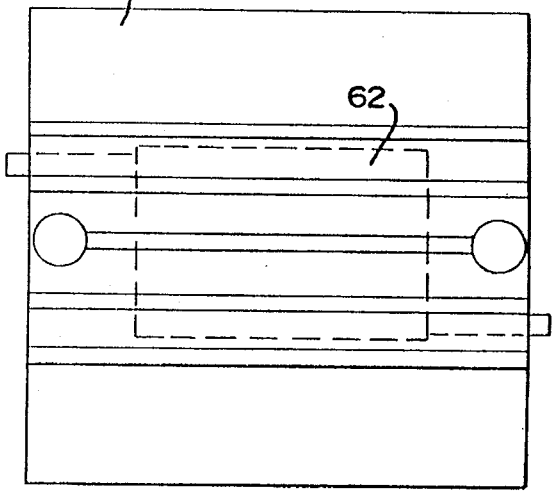
Figure 8A:
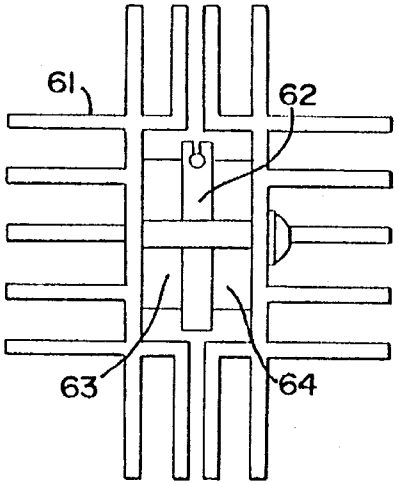

FIGS. 8, 8*a* and 8*b* disclose an alternate embodiment of a heat exchanger for use with the invention. This heat exchanger is convective air cooled rather than cooled by heat exchange liquid in situations where the ambient temperature is not expected to be significantly different than the temperature desired for the ink. In such cases, the liquid circulation system can be omitted. The TEDS pump heat from the ambient air to the ink to heat it or from the ink to the ambient air to cool the ink through the heat exchanger shown in FIGS. 8.

As shown in FIG. 8, the air-cooled embodiment using convective air employs a temperature control assembly 60 which is somewhat larger in diameter than the printhead housing 13. As shown in the end and side elevations of FIGS. 8*a* and 8*b*, assembly 60 consists of heat transfer fins 61 extending from the sides and top of the assembly. Centrally located in the assembly, is the heat exchanger for the ink 62 surrounded on either side by TEDS 63 and 64. The ink heat exchanger 62 is thermally coupled to the TEDS which, in turn, are thermally coupled to the fins 61. As with the FIG. 1 embodiment, the TEDS are controlled to transfer heat from the ink to the fins in the case of ink temperature above a selected value. Alternatively, the TEDS transfer heat from the fins which are exposed to the ambient air temperature to the ink the case that the ink is too cold.

The FIG. 8 embodiment eliminates the need for a liquid cooling medium and the pumping system described in connection with FIG. 3.

Figure 9:
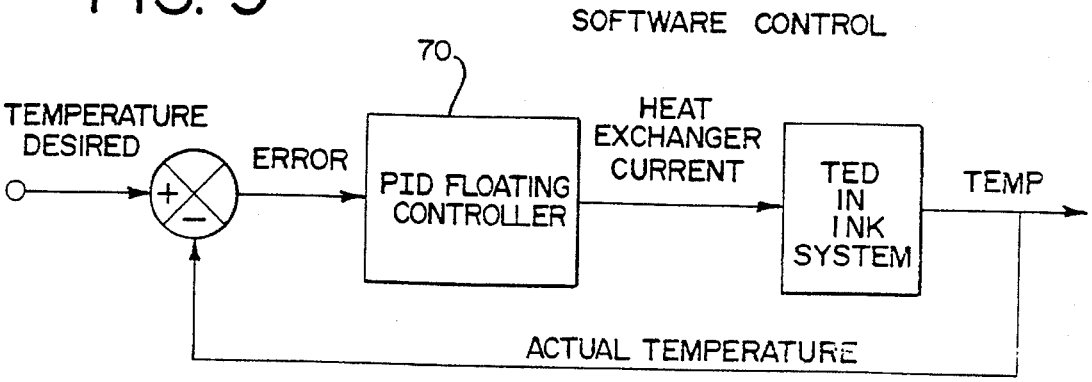
FIG. 9 is a block diagram of the control circuit.

Referring to FIG. 9, there is disclosed a block diagram of a software control system for use with the invention. Referring to the right-hand portion of FIG. 9, the temperature of the ink in the vicinity of the nozzle, as measured by the ink temperature sensor 20, is supplied as one input to a PID (proportional-integral-derivative) controller of the type commonly used in this art. The PID controller 70 compares the temperature, as measured by the sensor 20, against a set point temperature stored in a memory or look-up table associated with the control system. As a result of this comparison, the direction and, if desired, magnitude of the current supplied to the TEDS is controlled to cause such devices to pump heat to or from the ink. Since this is a feedback system employing PID control, relatively accurate temperature control can be obtained as both the present ink temperature and the rate of change of the temperature of the ink are factored into the control. It will be apparent to those of ordinary skill in the art that other types of feedback control can be employed in place of PID control as, for example, fuzzy logic and pulse width modulation with equal success.

In summary, the present invention provides temperature control directly at the printhead in a manner not previously available in this art. It is possible, using the present invention, to heat or cool the ink, as necessary, at the point of use, a location significantly removed from the cabinet containing the ink supply and control electronics. This ensures that the effects of the ambient environment on the ink can be offset to prevent deterioration of ink composition and printing quality. This improves print quality because the ink is operated at its optimum temperature and additionally permits more precise and meaningful measurement of the viscosity of the ink so that composition can be maintained stable.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed:

1. In an ink jet printer having a control cabinet, an ink supply in said cabinet and a remotely located printhead connected to said cabinet by an umbilical cord for supplying ink and control signals to said printhead the improvement comprising:

a) heat pump means comprising at least one thermoelectric device (TED) (40) disposed in said remotely located printhead (10) for transferring heat to or from said ink as a function of the polarity of the electric current applied to said TED;

b) means (20) for measuring an ink temperature in said printhead (10);

c) means (70) for comparing said ink temperature with a desired temperature range and for operating said TED to alter said ink temperature;

d) heat exchange means (42) in said printhead in thermal relation with said TED (40) for transferring heat to or from said TED to enhance the ability of said TED to maintain said ink temperature within said desired range;

e) said heat exchange means including a passageway (32, 34, 36) running therethrough for circulating a heat exchange liquid and;

f) means (50) for circulating said heat exchange liquid through said heat exchange means.

2. The apparatus of claim 1 wherein said umbilical cord includes ink supply and return conduits for providing ink to and returning ink from said printhead, said ink return conduit being disposed in thermal relation with said ink supply conduit to precondition the temperature of the supply ink prior to it reaching said heat pump means.

3. The apparatus of claim 1 wherein said means for comparing and for operating said heat pump means includes:

a feedback controller receiving as a first input said actual ink temperature and, as a second input, a value representative of said desired temperature range, said controller comparing said inputs and controlling said heat pump means as a function of said comparison.

4. The apparatus of claim 1 wherein said means for comparing and for operating said heat pump means includes:

a feedback controller receiving as a first input said actual ink temperature and, as a second input, a value representative of said desired temperature range, said controller altering the magnitude and direction of said electric current to said TED as a function of said comparison.

5. A method for maintaining the temperature of ink flowing in a remotely located printhead of an ink jet printer having a control cabinet, an ink supply in said cabinet, an umbilical cord for supplying ink to said remote printhead comprising the steps of:

a) disposing a heat pump comprising at least one thermoelectric device (TED) in said remote primhead for transferring heat to or from said ink;

b) measuring ink temperature in said printhead;

c) comparing said ink temperature with a desired temperature range;

d) operating said TED to alter said ink temperature to maintain it within said desired range;

e) disposing in said printhead a heat exchange element having a passageway running therethrough in thermal relation with said TED;

f) circulating a liquid through said passageway to transfer heat to or from said TED to enhance the ability of said TED to maintain actual ink temperature within said desired range.

* * * * *